US005154436A

United States Patent [19]

Jez et al.

[11] Patent Number: 5,154,436

[45] Date of Patent: Oct. 13, 1992

[54] WHEELED RIDING APPARATUS

[76] Inventors: Marek J. Jez, 53 Gladys Ave., Mountain View, Calif. 94043; Ronald A. Robeck, 864 Russell La., Milpitas, Calif. 95035

[21] Appl. No.: 619,116

[22] Filed: Nov. 27, 1990

[51] Int. Cl.[5] ..... A63C 17/02

[52] U.S. Cl. ..... 280/87.042; 280/1.28; 280/87.03; D21/227

[58] Field of Search ..... 280/87.042, 87.041, 280/87.03, 87.021, 87.01, 11.27, 11.28, 11.19; D21/227

[56] References Cited

U.S. PATENT DOCUMENTS

| | | | |
|---|---|---|---|
| D. 302,993 | 8/1989 | Heilig | D21/227 |
| 322,504 | 7/1885 | Thompson | 280/11.28 |
| 329,584 | 11/1885 | Miller | 280/11.28 |
| 1,640,476 | 8/1927 | Whitcomb, Jr. | 280/11.28 |
| 2,366,866 | 1/1945 | Moller | 280/11.19 |
| 3,751,062 | 8/1973 | White, Sr. | 280/87.042 |
| 4,092,033 | 5/1978 | Swain | 280/87.042 |
| 4,155,565 | 5/1979 | De Caussin et al. | 280/87.042 |
| 4,165,089 | 8/1979 | Urdea et al. | 280/87.042 |
| 4,295,656 | 10/1981 | Moore | 280/87.042 |
| 4,319,760 | 3/1982 | Romano | 280/11.115 |
| 4,337,963 | 7/1982 | Stevenson | 280/87.042 |
| 4,505,477 | 3/1985 | Wilkinson | 280/87.041 |
| 4,930,794 | 6/1990 | Chan | 280/87.042 |

FOREIGN PATENT DOCUMENTS

| | | | |
|---|---|---|---|
| 2467003 | 5/1981 | France | 280/87.042 |
| 1577818 | 10/1980 | United Kingdom | 280/87.042 |

*Primary Examiner*—Eric D. Culbreth

*Attorney, Agent, or Firm*—Rosenblum, Parish & Isaacs

[57] ABSTRACT

A wheeled riding apparatus having as a base embodiment a flexible skateboard including a flat board member, a pair of trucks and an elliptical leaf spring member. The leaf spring member is attached to each truck and is curved to support the flat board member when the weight of a rider is placed upon the board. The flat board member can be made thin and flexible, and, in combination with the leaf spring, allows an agile rider to perform dramatic stunts. In an alternative embodiment, a scooter having a board member with a sunken center section, a pair of trucks, a leaf spring with a compound curve and a T-handle is shown. The scooter incorporates the flexible board and leaf spring combination of the skateboard and lowers the center of gravity of adding a sunken midsection to the board to enhance rider stability and control. The added handle also aids in rider stability.

5 Claims, 3 Drawing Sheets

WHEELED RIDING APPARATUS

BACKGROUND OF THE INVENTION

1. Field of the Invention

The present invention relates generally to wheeled riding devices, and more particularly to skateboards and scooters having a flexible platform supported in part by an arcuate leaf spring member.

2. Brief Description of the Prior Art

U.S. Pat. No. 4,155,565 describes a skateboard with a pair of leaf springs. Each leaf spring is fixedly attached to the skateboard through a slide pad assembly at one end, and directly attached to a truck at the opposite end. The leaf spring is cantilevered from the slide pad to provide a springing action. Varying the location of the pad with respect to the leaf spring (which is in a fixed relationship with the skateboard) increases or decreases the length of the trucks on the cantilevered spring support, without changing the distance between the wheels, and varies the elasticity of the leaf spring.

Where each spring attaches to the board, two strong bolts are required for security The board must be of sufficient thickness and stiffness to accommodate the large bolts and bolt tightening requirements necessary to securely attach the leaf springs to the board. Therefore, the board is not flexible and thus does not enhance the stability or rider control of the skateboard.

Many other types of scooters and skateboards exist in the prior art, however none utilize a leaf spring for support, stability or control.

SUMMARY OF THE INVENTION

It is therefore a primary objective of the present invention is to provide an improved scooter having a leaf spring member supporting the base of the scooter.

Another objective of the present invention is to provide an improved scooter having a thin base that can flex, thereby enhancing rider control.

A further objective of the present invention is to provide an improved skateboard having a leaf spring member which provides stability and enhances rider control.

Yet another objective of the present invention is to provide an improved skateboard having a leaf spring member which allows the base of the skateboard to be made of a thin and flexible material.

Briefly, a preferred embodiment of the present invention includes a thin, generally rectangular base of aluminum or lightweight steel, having a pair of trucks mounted at opposite ends on the underside thereof, and a leaf spring member attached at each end to a truck. In an alternative embodiment, the base is sunken at its midsection and an upright, elongated handle having a stabilizing bar is attached to the top of said base at one end.

An advantage of the present invention is that it includes a single leaf spring member which provides support and stability for the rider.

Another advantage of the present invention is that the base can be made of thin material so that it is flexible, thus providing added control for the rider.

A further advantage of the present invention is that in the alternative embodiment, the sunken area of the base enhances stability of the scooter because the center of gravity is lowered.

These and other objects and advantages of the present invention will no doubt become apparent to those skilled in the art after having read the following detailed description of the preferred embodiment which is contained in and illustrated by the various drawing figures.

IN THE DRAWINGS

DETAILED DESCRIPTION OF THE PREFERRED EMBODIMENT

Figure 1:
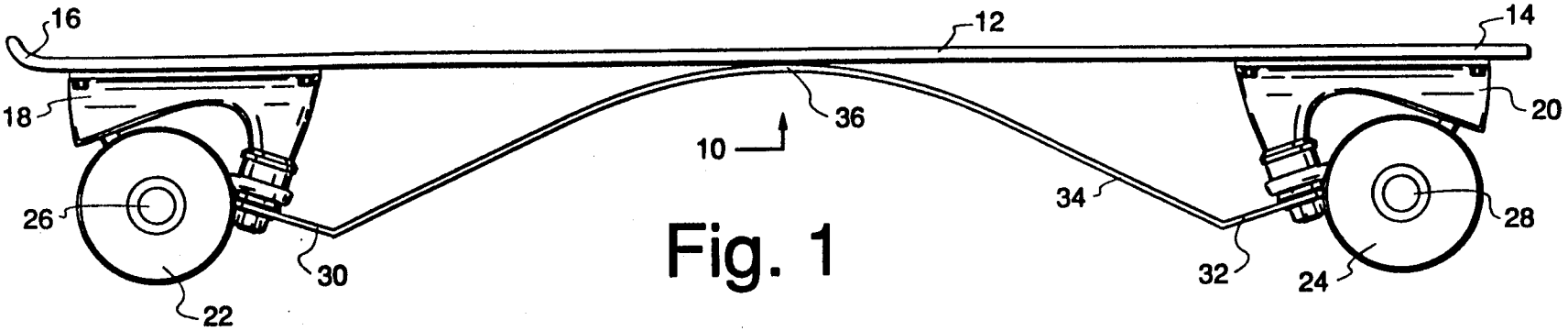
FIG. 1 is an elevational view of a skateboard embodiment of the present invention illustrating the flat board configuration with a compound curved leaf spring.

FIG. 1 illustrates a skateboard or scooter base 10 having a flat board member 12. While the front end 14 of the board remains flat, the opposite end of the board, the tail 16, curves upwardly The upwardly curving tail notifies the rider when his foot is nearing the end of the board, and also provides a foothold for the rider when he wants to "pop a wheelie"—or ride the skateboard on the back wheels only, keeping the front wheels off of the ground. The board member 12 of the present invention can be made thinner than those of the prior art because of the use of a leaf spring, discussed in detail to follow. The thin board is flexible and enhances the rider's control as well as aids the rider in executing dramatic stunts.

Attached to the underside of the board member 12, proximate the ends of the board, are a set of trucks 18 and 20. Each truck comprises a pair of wheels 22 and 24 connected to a common steerable axle 26 and 28. While riding the skateboard, turning is accomplished by shifting the rider's weight more towards one side of the board. For example, as the rider's weight shifts from the center of the board to the right side of the board, the axles will pivot so that the left wheel is forward of the right wheel causing the whole skateboard to turn toward the right.

One end 30 of a leaf spring member 34 is attached to one of the pair of trucks 18, and the other end 32 of the leaf spring is attached to the other truck 20. The leaf spring 34 is angled proximate each end, and the section of the leaf spring between the angles is elliptically shaped. The midpoint 36 of the arcuate leaf spring is not attached in any way to the board member 12, but rather engages the board member when a downward force from the weight of the rider is applied. The principal function of the leaf spring is to provide a resilient deformation restoring force to the board member 12. The flexibility and resiliency of the leaf spring are determined by the stiffness of the material comprising the leaf spring and also the length and shape of the arcuate midsection of the leaf spring. Stiffer materials lessen the flexibility of the spring. The flatter the curve of the leaf spring, the less the deformation (thus the "springiness") of the spring. A rider, accustomed to the feel of the leaf spring, can use the resiliency and flexibility of the spring to his advantage in doing stunts and agile moves on the skateboard.

Figure 2:
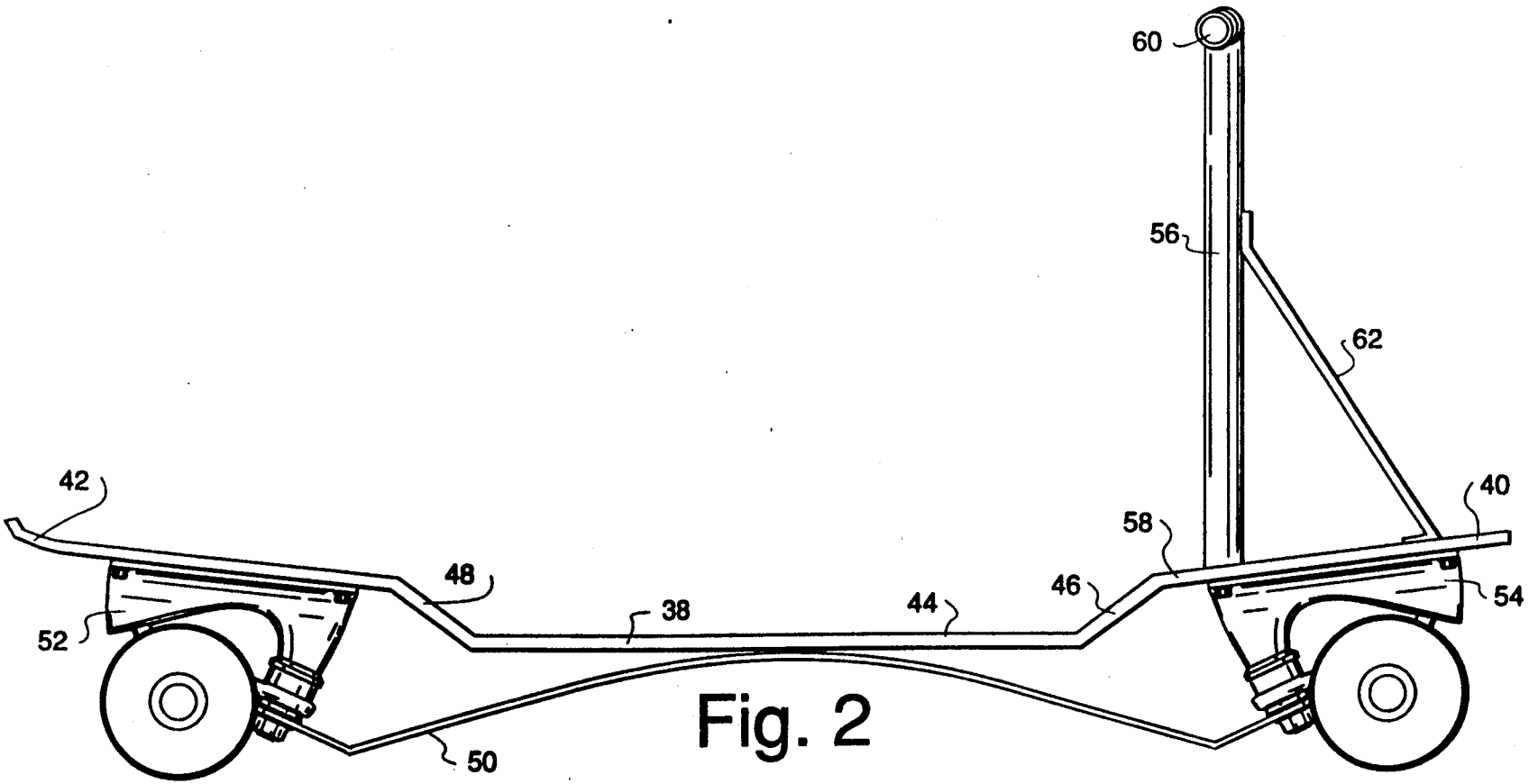
FIG. 2 is an elevational view of a scooter embodiment of the present invention showing an alternative sunken board and elliptical leaf spring member.

FIG. 2 is an elevational view of a scooter embodiment having an alternative leaf spring and board member combination in accordance with the present invention. As illustrated, the board member 38 for the scooter configuration has a flat front end 40 and an upwardly curving tail 42 similar to those of the skateboard embodiment of FIG. 1, but the midsection 44 of the scooter board member is sunken. The sunken midsection enhances the stability of the scooter because the center of gravity of the scooter is lowered. Additionally, by placing one foot up against the front wall 46 and the other foot up against the back wall 48 of the sunken midsection 44, a novice rider will feel more securely balanced.

The leaf spring 50 is attached to the trucks 52 and 54 angled proximate each end similar to the leaf spring described in FIG. 1, but the section between the angles is a compound curve (the central portion is cured differently from the outer portions of this section) instead of an elliptical curve. Both the compound curved leaf spring and the elliptical leaf spring function in a similar manner, however the leaf spring with the compound curve allows less deformation. Both configurations of the leaf spring are provided to illustrate that different materials may be used to make the spring. Thinner or lightweight materials can be used with the stiffer, less flexible design.

The scooter also includes a vertical shaft 56 which is attached at one end to the top side 58 of the flat front end 40 of the board member 38. The opposite end of the shaft is attached to a short, horizontal handle 60. The shaft 56 is reenforced by a strut 62 which attaches on one end to the midpoint of the vertical shaft 56 and on the opposite end to the front end 40 of the board member 38. The handle aids the rider in balancing atop the scooter, and can be used to effectuate jumps and other aerial maneuvers.

Figure 3:
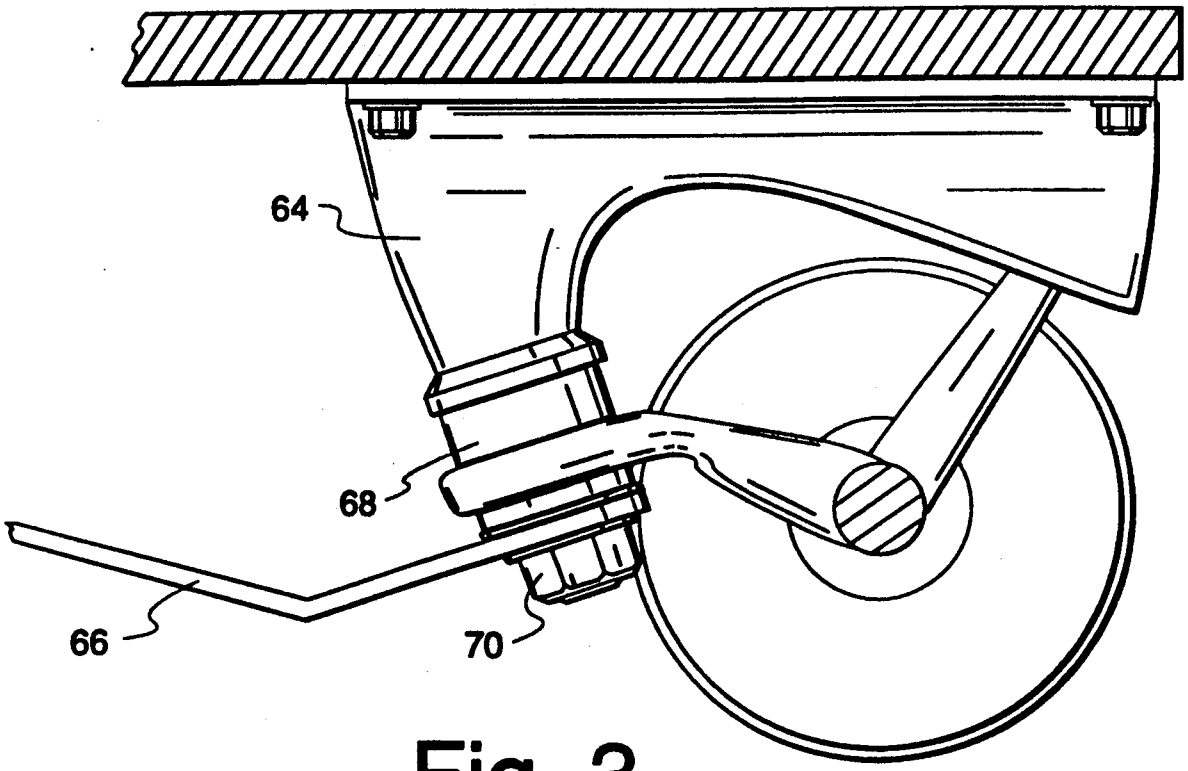
FIG. 3 is a partially broken side view of a truck having one wheel, removed in order to view the connection of the leaf spring member to said truck.

FIG. 3 is a side view of a truck 64 with one wheel removed to show how the leaf spring 66 is attached to the truck 64. The leaf spring 66 is fastened to the truck 64 between the resilient member 68 and the nut 70 that holds the resilient member on the truck.

Although the present invention has been described above in terms of a specific embodiment, it is anticipated that alterations and modifications thereof will no doubt become apparent to those skilled in the art. It is therefore intended that the following claims be interpreted as covering all such alterations and modifications as fall within the true spirit and scope of the invention.

What is claimed is:

1. An elongated wheeled riding apparatus adapted to support both feet of a rider at points midway along its length comprising:

a flexible metal board member having a top side, an underside, a flat front portion, a flat rear portion, and a central portion connecting the front portion and rear portion, the central portion being located in a plane beneath a plane including said front and rear portions;

a pair of trucks, each having two wheels mounted on a steerable axle, the first said truck being attached to said underside of said board member at said front portion and the second said truck being attached to said underside of said board member at said rear portion;

a leaf spring member having an angle proximate each end and being fixedly attached by its ends to each of said trucks at a point below the laces of said pair of trucks, the central portion of said leaf spring member between said angles being deformed upwardly such that the midsection of said central portion supportingly engages said underside of said central of said board member portion of said flexible board member such that downward deformation of said central portion by the weight of a rider is resiliently resisted by said leaf spring member and the resisting force is transferred to said trucks at the points of attachment of said ends; and a vertical shaft having a first end and a second end, said first end being attached to said top side of said front portion of said board member, and having a horizontal handle bar attached to said second end.

2. A wheeled riding apparatus as recited in claim 1 wherein the rearmost extremity of said rear portion of said board member is curved upwardly for additional stability and rider control.

3. A wheeled riding apparatus as recited in claim 1 wherein the section of said leaf spring member between said angles has a compound curve, including an apex at the midpoint of said leaf spring member, providing resilient deformation restoring force to said board member.

4. A wheeled riding apparatus as recited in claim 1 wherein the section of said leaf spring member between said angles is elliptical, providing resilient deformation restoring force to said board member.

5. A wheeled riding apparatus as recited in claim 1 further comprising an elongated stabilizer having a first end and a second end, said first end attached to said vertical shaft and said second end attached to said front portion of said board member.

* * * * *